US006606390B2

(12) United States Patent
Azima

(10) Patent No.: US 6,606,390 B2
(45) Date of Patent: Aug. 12, 2003

(54) LOUDSPEAKERS

(75) Inventor: Henry Azima, Cambridge (GB)

(73) Assignee: New Transducer Limited, London (GB)

( * ) Notice: Subject to any disclaimer, the term of this patent is extended or adjusted under 35 U.S.C. 154(b) by 0 days.

(21) Appl. No.: 09/925,473

(22) Filed: Aug. 10, 2001

(65) Prior Publication Data

US 2001/0055402 A1 Dec. 27, 2001

Related U.S. Application Data

(63) Continuation-in-part of application No. 09/417,052, filed on Oct. 13, 1999, now Pat. No. 6,278,787, which is a continuation-in-part of application No. 08/707,012, filed on Sep. 3, 1996.

(60) Provisional application No. 60/150,804, filed on Aug. 26, 1999.

(30) Foreign Application Priority Data

Oct. 13, 1998 (GB) ..... 9822246

(51) Int. Cl.[7] ..... H04R 25/00

(52) U.S. Cl. ..... 381/152; 381/398

(58) Field of Search ..... 381/152, 398, 381/425, 396, 353, 354, 423, 431, 426, FOR 162; 181/150

(56) References Cited

U.S. PATENT DOCUMENTS

| | | | | |
|---|---|---|---|---|
| 3,247,925 A | * | 4/1966 | warnaka | |
| 4,284,167 A | | 8/1981 | Kozlow et al. | |
| 4,392,027 A | * | 7/1983 | Bock | |
| 4,506,117 A | * | 3/1985 | Fresard | |
| 4,903,308 A | * | 2/1990 | Paddock et al. | |
| 4,928,312 A | | 5/1990 | Hill | |
| 6,278,787 B1 | * | 8/2001 | Azima | |

FOREIGN PATENT DOCUMENTS

| | | |
|---|---|---|
| EP | 0 969 691 A1 | 1/2000 |
| WO | WO 93/11649 A1 | 6/1993 |
| WO | WO 97/09842 | 3/1997 |
| WO | WO 98/31188 | 7/1998 |
| WO | WO 98/34320 | 8/1998 |

* cited by examiner

*Primary Examiner*—Sinh Tran
(74) *Attorney, Agent, or Firm*—Foley & Lardner

(57) ABSTRACT

A mid/high frequency loudspeaker comprising a stiff light-weight resonant panel form member, a housing in which the panel form member is mounted, a suspension connected between the edges of the panel-form member and the housing and by means of which the panel edges are restrained against movement, the arrangement being such that the housing and the panel-form member together define a cavity, and an electrodynamic exciter for applying bending wave energy to the panel-form member to cause it to resonate to produce an acoustic output, the exciter comprising a magnet assembly rigidly fixed to the housing and defining an annular gap, and a voice coil and coil former assembly disposed in the annular gap and rigidly fixed to the panel-form member near to the geometric center thereof, wherein only said panel suspension centers the voice coil and coil former assembly in the annular gap.

17 Claims, 4 Drawing Sheets

LOUDSPEAKERS

This application is a continuation-in-part of application Ser. No. 09/417,052, filed Oct. 13, 1999, now U.S. Pat. No. 6,278,787 which is a continuation-in-part of application Ser. No. 08/707,012, filed Sep. 3, 1996, and also claims the benefit of Provisional Application No. 60/150,804, filed Aug. 26, 1999.

TECHNICAL FIELD

The invention relates to loudspeakers and more particularly to resonant panel loudspeakers, e.g. of the kind described in International patent application WO97/09842, i.e. so-called distributed mode loudspeakers.

BACKGROUND ART

In the past there has been great difficulty in providing a loudspeaker covering the mid and high frequency audio range with high quality. Directivity varies greatly in this range and extension to the highest frequencies is very difficult for a mid driver alone. Typically two drivers are used with the expense and complication of a crossover network to divide the frequency range between them. The crossover frequency is generally around 3 kHz which is the most sensitive region in human hearing and which adds to the difficulty.

The concept of the present invention is to devise a mid and high frequency driver which replaces the two convention drivers previously used, which does not crossover in the critical region and which has consistent, desirably wide directivity throughout its working range.

Distributed mode loudspeakers can be designed to operate over some 8-Octaves of the audio frequency band, although this may not always be the best solution, for instance in hi-fi applications. It is envisaged that it might sometimes be appropriate for a distributed mode loudspeaker to be used in association with a subwoofer for low frequencies, crossing over, say, at around 100 to 200 Hz.

There is therefore a need for a loudspeaker or at least a loudspeaker drive unit that is not meant necessarily to work over 8-Octaves but perhaps over 6 to 7 Octaves of the audio band, which would allow a wide choice of material and various construction possibilities that would help optimise the loudspeaker over its operating range. An example of this is a hi-fi midrange/tweeter drive unit working under the distributed mode loudspeaker principle. This can bring significant benefits to a conventional boxed loudspeaker system by allowing the cross-over point to be designed away from the critical 3 kHz area down to 1 kHz range, typically 300–500 Hz as well as benefiting from the superior radiation properties associated with a distributed mode loudspeaker.

There is also an expanding market in multimedia and computer peripherals for high performance compact speakers and ever increasing demand for better sound and more compact construction for conventional televisions, monitors and flat panel televisions.

Thus there is a need for a structure that can be very compact and which can allow numerous features to be added for performance enhancement, application versatility and cost saving.

The present invention provides a cost-effective vehicle for all such applications and allows a manufacturer to optimise on tooling outlay and its production processes.

The basic concept revolves around a simple construction of the loudspeaker "engine" or drive unit which would allow easy production assembly and provide consistency.

DISCLOSURE OF INVENTION

According to the invention there is provided a mid/high frequency loudspeaker comprising a stiff lightweight resonant panel-form member, a housing to which the panel-form member is mounted, a suspension connected between the edges of the panel-form member and the housing and by means of which the panel edges are restrained against movement, the arrangement being such that the housing and the panel-form member together define a cavity at least partially enclosing a face of the panel, and an electrodynamic exciter for applying bending wave energy to the panel-form member to cause it to resonant to produce an acoustic output, the exciter comprising a magnet assembly rigidly fixed to the housing and defining an annular gap, and a voice coil and coil former assembly disposed in the annular gap and rigidly fixed to the panel-form member near to the geometric centre thereof, wherein only said panel suspension centres the voice coil and coil former assembly in the annular gap.

The bending stiffness of the panel-form member may be in the range 0.15 Nm to 24 Nm and is preferably in the range 2 Nm to 9 Nm.

The vibration exciter may be bonded to the panel-form member (herein after 'panel') and/or to the enclosure by way of injection moulding or by use of the adhesive. The vibration exciter voice coil may be bonded directly to a resonant panel during the injection moulding of the panel. Alternatively the voice coil of an exciter may be bonded into a pre-formed aperture moulded in a resonant panel during assembly. The need for a separate voice coil carrier is thus removed.

The panel may be co-moulded with the suspension. The suspension may be of a hard or semi-rigid foam plastics material. Alternatively, the panel may be fixed by adhesive means directly to the housing or enclosure, in which case the suspension is the adhesive connection between the panel and housing or enclosure.

The panel may be injection moulded as a monolith or using foaming techniques. The panel may be flat or curved and may vary in thickness or cross-section.

The enclosure may have embedded electrically conducting inserts for carrying electrical signals efficiently from connectors on the enclosure edge to the vibration exciter. The assembly and connectivity of the drive unit may thus be automated.

The mid/high frequency speaker may be clad in other mouldings and structures to suit the application, e.g. for aesthetic reasons. For example an appropriate trim will make it suitable for surface mounting onto a hi-fi speaker cabinet. The mid/high frequency speaker may be a drive unit or engine and the engine may be mounted onto other structures such as television cabinets.

BRIEF DESCRIPTION OF DRAWINGS

The invention is diagrammatically illustrated, by way of example in the accompanying drawings, in which.

BEST MODE FOR CARRYING OUT THE INVENTION

Figure 1:
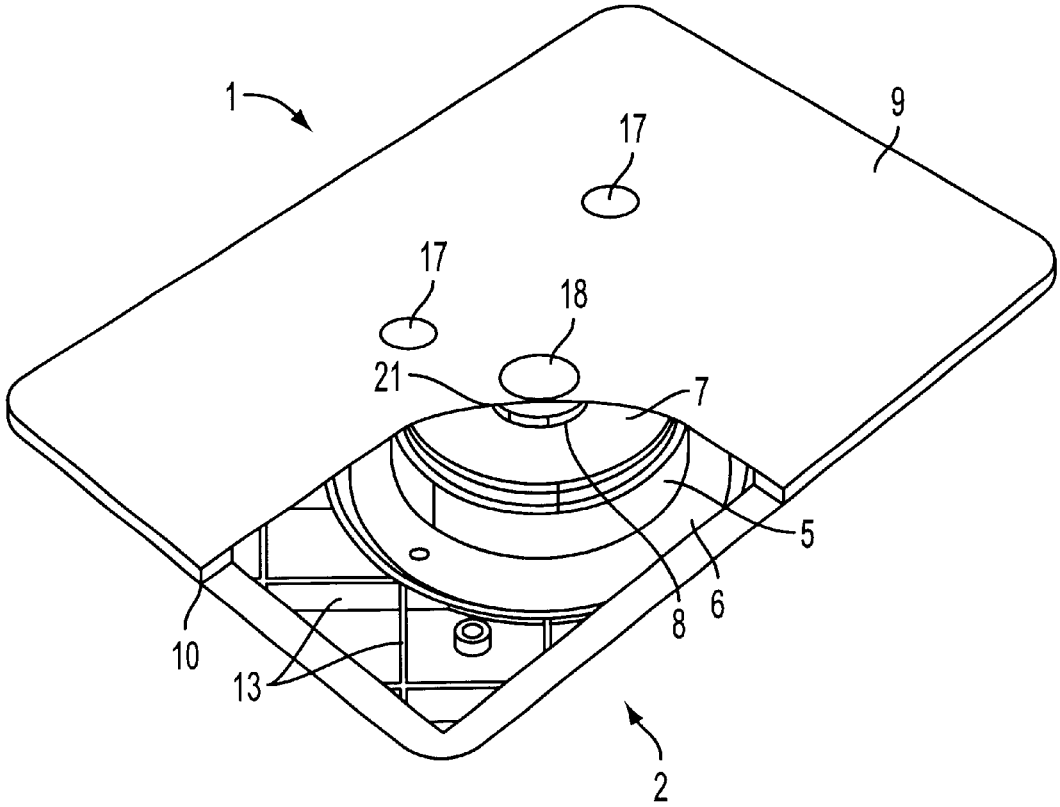
FIG. 1 is a perspective view, partly cut-away to reveal hidden detail, of a mid/high frequency loudspeaker according to the present invention.
Figure 2:
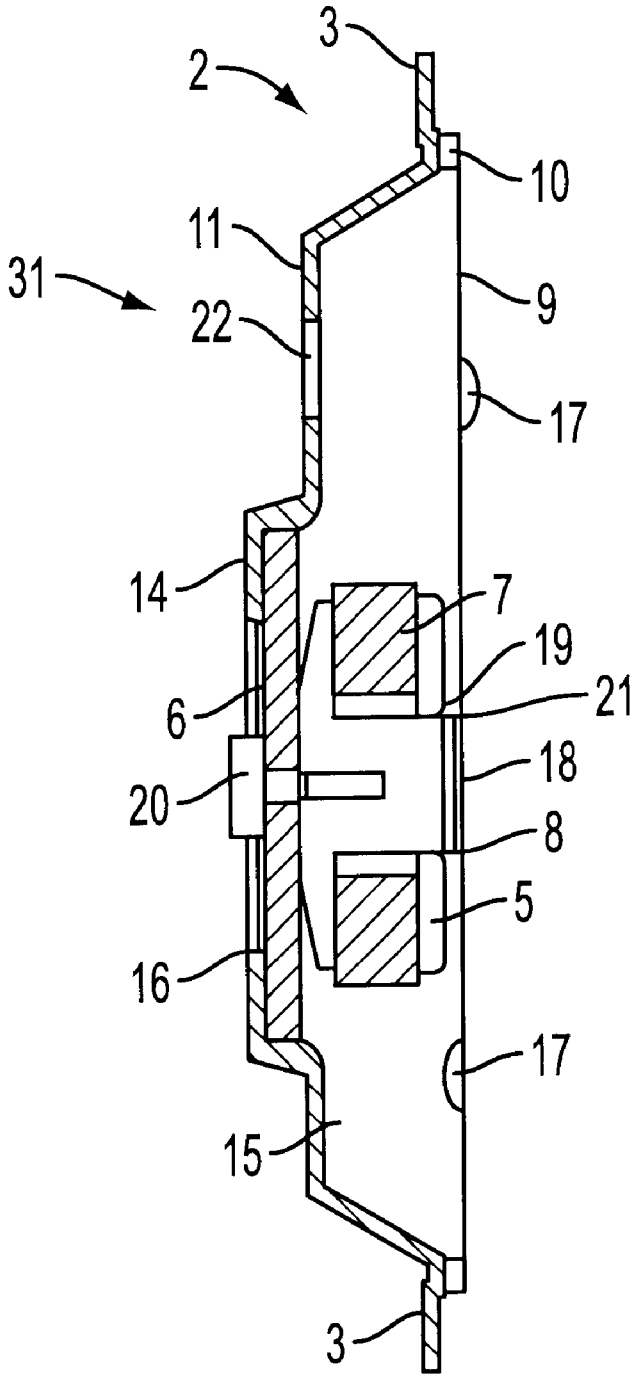
FIG. 2 is a cross-sectional side view of a mid/high frequency loudspeaker according to a second aspect of the present invention.
Figure 4:
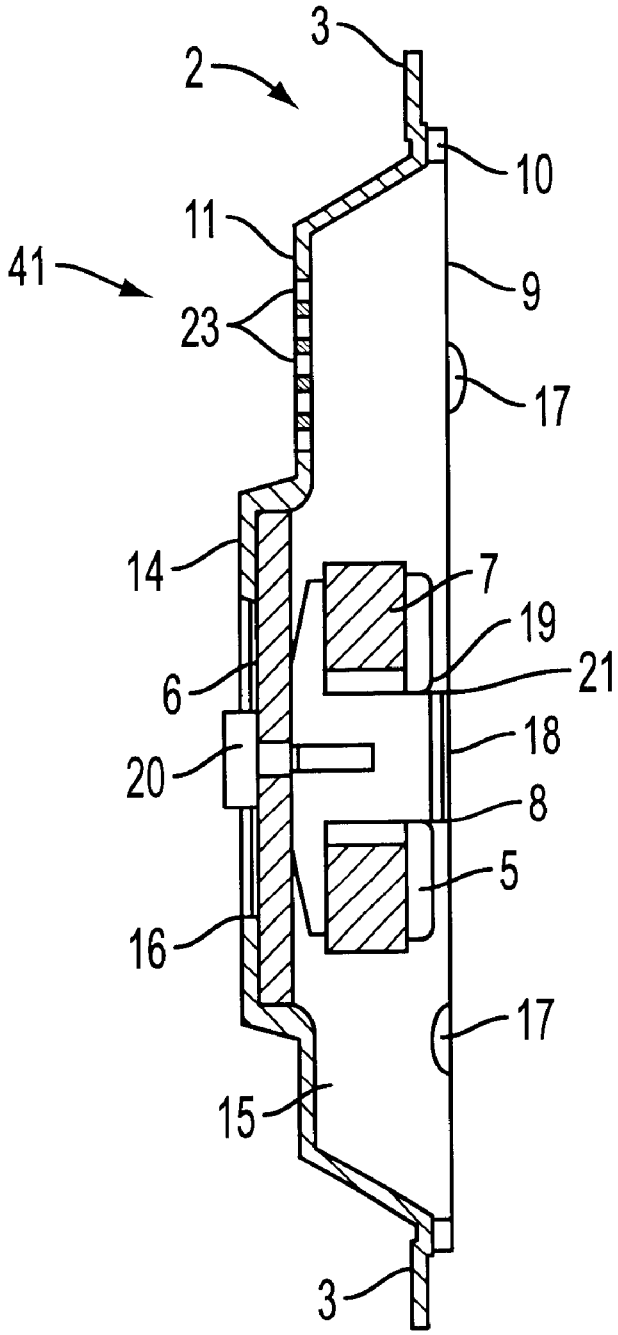
FIG. 4 is a cross-sectional side view of a mid/high frequency loudspeaker according to a third aspect of the present invention.

FIGS. 1, 2 and 4 each show a loudspeaker 1, 31, 41 intended as a mid/high frequency speaker which may be used as a component or engine or driver in a loudspeaker system also comprising a low frequency driver in which case the mid/high frequency and low frequency drivers may be assembled into a common cabinet, or as the sole driver in a compact loudspeaker, e.g. for multi-media or computer or automobile use. The loudspeakers 1, 31 and 41 shown in FIGS. 1, 2 and 4 are similar and features in common have been marked with the same reference number.

The speakers 1, 31 and 41 each comprise a generally rectangular housing or enclosure 2 having a dish-like body 11. As is shown in FIGS. 2 and 4, the enclosure may be surrounded by an outwardly extending fixing flange 3 which may be formed at intervals with holes (not shown) whereby the enclosure can be fixed in position by means of suitable fasteners (not shown) e.g. in the cabinet (not shown) of a larger loudspeaker. Alternatively, the enclosure could be formed as a stand-alone structure e.g. for a multi-media personal computer or the like. The enclosure 2 may be made from plastics, e.g. by injection moulding, and is formed internally with cross-bracing flanges 13 in the interests of adding stiffness to the enclosure while retaining its light-weight nature.

The enclosure 2 is formed at its base 14 with an internal generally circular shallow recess having a central through hole 16, the recess being adapted snugly to receive a circular backing plate 6 on which is rigidly mounted a magnet assembly 7 of an electrodynamic vibration exciter 5 by means of a bolt 20. The exciter 5 comprises the said magnet assembly which defines an annular gap 19, and a voice coil and cylindrical former assembly 8 disposed in the annular gap and moveable axially thereof in response to an electrical signal applied to the voice coil. The backing plate 6 is fixed to the enclosure in any convenient manner. Thus it may be fixed by fasteners or by adhesive means or may be moulded integrally with the enclosure.

A generally rectangular resonant panel-form member or panel 9 which is capable of supporting bending wave vibration is mounted on the enclosure 2 by means of a suspension 10 of hard or semi-rigid strips of foam which extends round the periphery of the panel 9 so that the panel edge is restrained against movement. The panel 9 may be a stiff, lightweight member. In FIGS. 2 and 4, the panel 9 is mounted adjacent the flange 3.

The enclosure and the panel thus define a substantially closed cavity 15 enclosing one face of the panel. As shown in FIG. 2, the cavity 15 may be vented via a port 22 in a rear face of the enclosure. Alternatively, as shown in FIG. 4, the cavity 15 may be vented via a series of small holes or apertures 23 in the rear face of the enclosure. This may be considered to be distributed venting.

The suspension 10 may be fixed to the panel 9 and to the enclosure 2 by adhesive means or alternatively the panel may be fixed directly to the enclosure by adhesive means, i.e. omitting the strips of foam. The panel 9 is a distributed mode panel in accordance with the teaching in WO97/09842.

The voice coil/former assembly 8 of the exciter 5 is rigidly fixed to the panel 9 at a suitable near-centre drive position as taught in WO97/09842 to introduce bending wave energy into the panel to cause it to resonate to produce an acoustic output. The voice coil and coil former assembly 8 has an annular mounting member or foot 21, e.g. of plastics, rigidly fixed to its end adjacent to the panel 9 to aid its fixing to the panel, which may be with the aid of an adhesive. It is to be noted that, unusually, the exciter 5 is grounded to the enclosure 2 and does not comprise a suspension between the magnet assembly and the voice coil so that centring of the voice coil in the annular gap 19 of the magnet assembly is achieved only by the panel edge suspension 10. In this way the moving mass of the exciter is reduced to improve its high frequency response. The magnet assembly may be thermally coupled to the voice coil to improve its power capacity and heat may be radiated from the exposed rear face of the backing plate 6.

Selective locally positioned small masses 17, e.g. in the range from about 2 to 12 grams are bonded to the panel to optimally tune the coupled resonances such that the overall response is suitably tailored. This technique has the specific advantage of extending the low frequency range of the assembly. An aperture 18 through the panel 9 coaxial with the voice coil extends the high frequency response. Some acoustic absorbent material (not shown) in the cavity 15 may be helpful in reducing the magnitude of higher order standing waves in the cavity, and may further refine the frequency response.

A drive unit as described above may have the following specification:

Panel size=210×148.5 mm (A5 std. size)

Core=3 mm polycarbonate honeycomb, 3.5 mm cell diameter

Skins=100 $\mu$m woven glass reinforced polycarbonate faceskins (0°/90° skin orientation) 50 wt % glass Bending stiffness=5.6 Nm Areal density, $\mu$=0.7 kg/m2

Zm=16 Ns/m

Voice coil diameter=26 mm

Coil is positioned at standard distributed mode position (4/9, 3/7=ratio)

Large ferrite ring magnet to improve BL and power handling.

Figure 3:
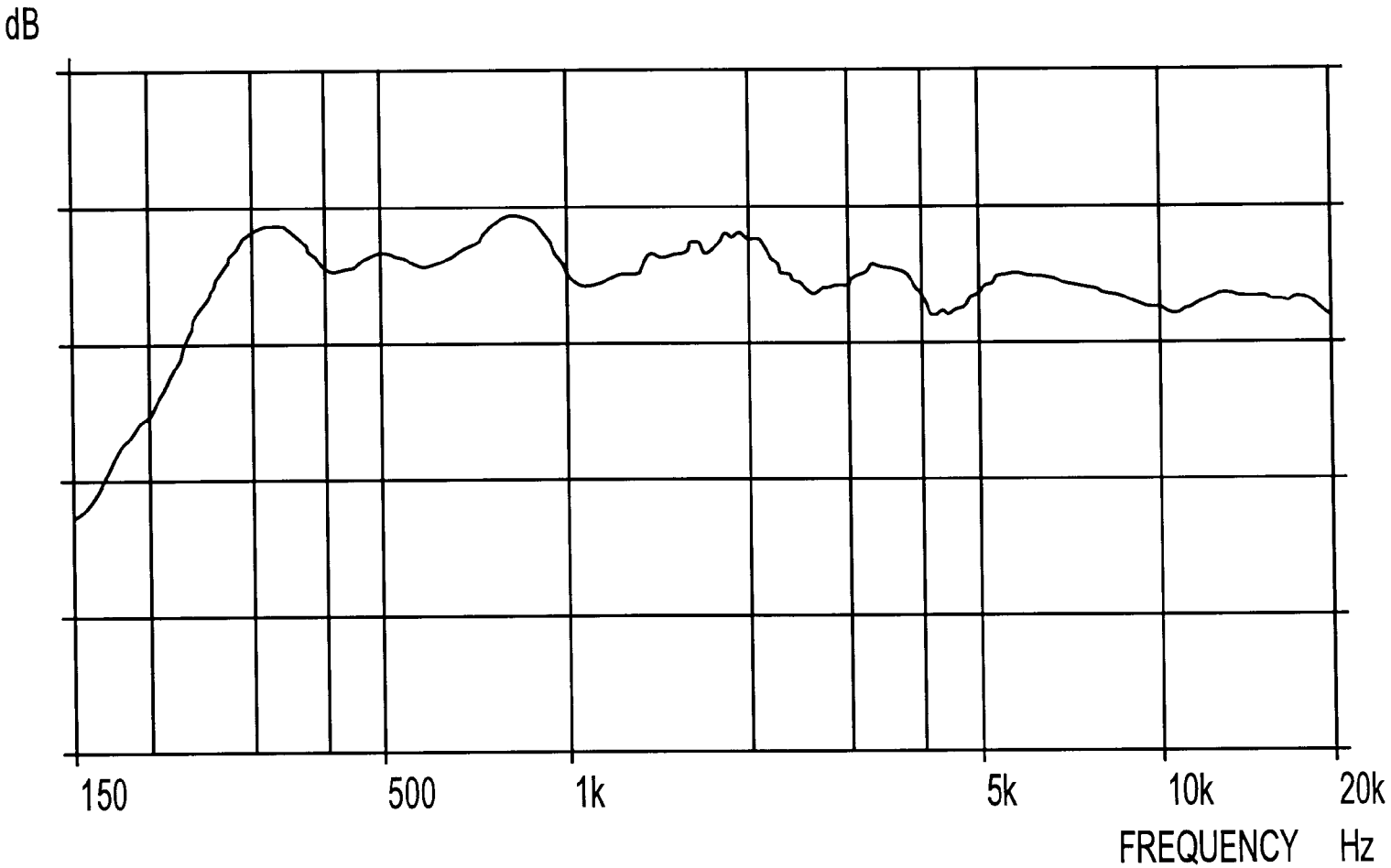
FIG. 3 is a graph representing the frequency response of the speaker of FIG. 2.

As discussed, there is no suspension between the magnet and the voice coil and the panel is held in position by the hard foam suspension around the panel edge. The panel may be aligned and located accurately using the hole in the panel within the voice coil to assist alignment of the voice coil in the annular gap. Locating pins might possibly be provided on the enclosure near to the panel edges to prevent sideways movement of the panel. The frequency response of such a panel, e.g the embodiment shown in FIG. 2 is shown in FIG. 3.

Smaller versions of the speaker are envisioned with high quality piezo exciters which may extend the response into the ultrasonic range which could be useful in connection with new audio formats with a 50 kHz or 100 kHz sound bandwidth; this performance is beyond the compass of conventional pistonic technology.

INDUSTRIAL APPLICABILITY

The invention thus provides a novel loudspeaker or speaker for mid and high frequencies which solves significant problems in known arrangements both as concerns frequency cross-over problems and dispersion.

What is claimed is:

1. A mid/high frequency loudspeaker comprising a stiff lightweight resonant panel-form member having a core defining portion sandwiched between skin layer defining portions and a bending stiffness in the range of from about 0.15 Nm to about 24 Nm, a housing in which the panel-form member is mounted, a suspension connected between the edges of the panel-form member and the housing and by means of which the panel edges are restrained against movement, the arrangement being such that the housing and the panel-form member together define a substantially closed cavity, and an electrodynamic exciter for applying bending wave energy to the panel-form member to cause it to resonate to produce an acoustic output, the exciter comprising a magnet assembly rigidly fixed to the housing and defining an annular gap, and a voice coil and coil former assembly disposed in the annular gap and rigidly fixed to the panel-form member near to the geometric centre thereof, wherein only said panel suspension centres the voice coil and coil former assembly in the annular gap.

2. A loudspeaker according to claim 1, wherein the housing comprises a dished body surrounded by a fixing flange.

3. A loudspeaker according to claim 2, wherein the dished body comprises a through aperture and wherein the magnet assembly of the vibration exciter is rigidly mounted on the dished body whereby a part of its surface closes the through aperture in the body.

4. A loudspeaker according to claim 3, comprising a recess in the dished body, and wherein the magnet assembly comprises a back plate mounted in the recess in the dished body, the recess being formed with the through aperture.

5. A loudspeaker according to claim 3, comprising an aperture through the panel-form member and coaxial with and smaller than the diameter of the voice coil.

6. A loudspeaker according to claim 5, comprising at least one discrete mass mounted on the panel-form member and positioned to damp the low frequency response thereof.

7. A loudspeaker according to claim 1, wherein the suspension is of a hard or semi-rigid foam plastics material.

8. A loudspeaker according to claim 1, wherein the suspension is an adhesive connection between the housing and the panel-form member.

9. A loudspeaker according to claim 1, wherein the bending stiffness is in the range of from about 2 Nm to about 9 Nm.

10. A loudspeaker according to claim 1, comprising an aperture through the panel-form member and coaxial with and smaller than the diameter of the voice coil.

11. A loudspeaker according to claim 10, comprising at least one discrete mass mounted on the panel-form member and positioned to damp the low frequency response thereof.

12. A loudspeaker according to claim 1, comprising at least one discrete mass mounted on the panel-form member and positioned to damp the low frequency response thereof.

13. A loudspeaker according to claim 1, comprising a port in the housing whereby the cavity is vented.

14. A loudspeaker according to claim 1, wherein the suspension firmly fixes the panel edges to the housing.

15. A mid/high frequency loudspeaker comprising a panel form member which is capable of supporting bending waves, the member having a core defining portion sandwiched between skin layer defining portions and a bending stiffness in the range of from about 0.15 Nm to about 24 Nm, a housing in which the panel form member is mounted, a mounting which secures the edges of the panel-form member to the housing and which restrains the panel edges against movement, the arrangement being such that the housing and the panel-form member together define a substantially closed cavity, and an electrodynamic exciter for applying bending wave energy to the panel-form member to cause it to produce an acoustic output, the exciter comprising a magnet assembly rigidly fixed to the housing and defining an annular gap, and a voice coil and coil former assembly disposed in the annular gap and rigidly fixed to the panel-form member near to the geometric centre thereof, wherein only said mounting centres the voice coil and coil former assembly in the annular gap.

16. A loudspeaker according to claim 15, wherein the mounting is in the form of a suspension formed from a hard or semi-rigid foam plastics material.

17. A loudspeaker according to claim 15, wherein the mounting is an adhesive bond which fixes the panel-form member directly to the housing.

* * * * *